US011011120B2

(12) United States Patent
Pyun et al.

(10) Patent No.: US 11,011,120 B2
(45) Date of Patent: May 18, 2021

(54) DISPLAY DEVICE

(71) Applicant: SAMSUNG DISPLAY CO., LTD., Yongin-si (KR)

(72) Inventors: Ki Hyun Pyun, Yongin-si (KR); Myoung Seop Song, Yongin-si (KR); Myung Ho Lee, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/806,012

(22) Filed: Mar. 2, 2020

(65) Prior Publication Data

US 2020/0357346 A1 Nov. 12, 2020

(30) Foreign Application Priority Data

May 10, 2019 (KR) ..... 10-2019-0055216

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2310/027* (2013.01); *G09G 2310/0248* (2013.01)

(58) Field of Classification Search
CPC ..... G09G 3/3291; G09G 3/3266; G09G 2310/0251
See application file for complete search history.

(56) References Cited

U.S. PATENT DOCUMENTS

| | | | | |
|---|---|---|---|---|
| 7,486,264 | B2 | 2/2009 | Taguchi | |
| 7,714,811 | B2 * | 5/2010 | Kim | G09G 3/3283 345/76 |
| 7,903,070 | B2 | 3/2011 | Moon et al. | |
| 9,767,759 | B2 | 9/2017 | Shin et al. | |
| 2007/0046609 | A1 * | 3/2007 | Lee | G09G 3/3648 345/94 |
| 2015/0116386 | A1 * | 4/2015 | Shin | G09G 3/3688 345/694 |
| 2016/0063960 | A1 * | 3/2016 | Pyun | G09G 3/3648 345/213 |
| 2019/0041682 | A1 | 2/2019 | Nakanishi et al. | |
| 2019/0044503 | A1 | 2/2019 | Cho | |

FOREIGN PATENT DOCUMENTS

| | | |
|---|---|---|
| JP | 4170242 | 8/2008 |
| KR | 10-1243804 | 3/2013 |
| KR | 10-2015-0050202 | 5/2015 |

* cited by examiner

*Primary Examiner* — Sardis F Azongha
(74) *Attorney, Agent, or Firm* — F. Chau & Associates, LLC

(57) ABSTRACT

A display device includes: first pixels coupled to data lines and a first scan line; second pixels coupled to the data lines and a second scan line; a data driver for sequentially supplying, to the data lines, first data voltages corresponding to first grayscale values of the first pixels and second data voltages corresponding to second grayscale values of the second pixels; a scan driver for supplying a first scan signal to the first scan line, and supplying a second scan signal to the second scan line; and a precharge controller for determining a width of a pulse of the second scan signal, based on a comparison result of the second grayscale values and previous frame grayscale values and a comparison result of the first grayscale values and the second grayscale values.

20 Claims, 10 Drawing Sheets

<EXEMPLARY DATA 1>

<EXEMPLARY DATA 1>

<EXEMPLARY DATA 2>

<EXEMPLARY DATA 2>

<EXEMPLARY DATA 3>

<EXEMPLARY DATA 3>

DISPLAY DEVICE

CROSS-REFERENCE TO RELATED APPLICATION

The present application claims priority under 35 U.S.C. § 119(a) to Korean patent application no. 10-2019-0055216, filed on May 10, 2019 in the Korean Intellectual Property Office, the entire disclosure of which is incorporated herein by reference.

TECHNICAL FIELD

The present disclosure generally relates to a display device having a comparative precharge stage.

DISCUSSION OF RELATED ART

With the ongoing development of information technologies, the importance of the man-machine interface is likely to increase. A display device forms an integral part of the man-machine interface by providing a connection medium between a user and visual information. Accordingly, display devices of higher resolution, such as liquid crystal display devices, organic light emitting display devices, and plasma display devices, are increasingly sought.

When high-resolution display devices are driven at the same or comparable driving frequency as low-resolution display devices, a time interval for a high-resolution display device to charge a data voltage to each pixel may be insufficient as compared with a low-resolution display device.

SUMMARY

Exemplary embodiments of the present inventive concept provide a display device capable of properly determining an amount of precharge according to a pattern of image frames.

In accordance with an aspect of the present disclosure, an exemplary embodiment display device is provided, including: first pixels coupled to data lines and a first scan line; second pixels coupled to the data lines and a second scan line; a data driver configured to sequentially supply, to the data lines, first data voltages corresponding to first grayscale values of the first pixels and second data voltages corresponding to second grayscale values of the second pixels; a scan driver configured to supply a first scan signal to the first scan line, and supply a second scan signal to the second scan line; and a precharge controller configured to determine a width of a pulse of the second scan signal, based on a comparison result of the second grayscale values and previous frame grayscale values and a comparison result of the first grayscale values and the second grayscale values.

The precharge controller may determine the width of the pulse of the second scan signal, based on a smaller value between a first difference value as a difference between the second grayscale values and the previous frame grayscale values and a second difference value as a difference between the first grayscale values and the second grayscale values.

The precharge controller may decrease the width of the pulse of the second scan signal as the smaller value is increased.

The precharge controller may include: a frame comparator configured to provide the first difference value by comparing the second grayscale values and the previous frame grayscale values; a line comparator configured to provide the second difference value by comparing the first grayscale values and the second grayscale values; and a precharge signal generator configured to apply a first precharge control pulse to a first precharge control line, based on a comparison result of the frame comparator and the line comparator, and apply a second precharge control pulse to a second precharge control line, based on a next comparison result. The first precharge control pulse and the second precharge control pulse may not temporally overlap with each other.

The precharge controller may further include: a first line memory configured to store the first grayscale values; a second line memory configured to store the second grayscale values; and a frame memory configured to store the previous frame grayscale values.

The frame memory may replace grayscale values stored therein that have been compared by the frame comparator with grayscale values provided by the second line memory.

The first line memory may replace grayscale values stored therein that have been compared by the line comparator with grayscale values provided by the second line memory.

The scan driver may include: scan stages configured to sequentially provide scan output signals having scan output pulses to the scan output lines; XOR gates having first input terminals coupled to the scan output lines and second input terminals coupled to one of the first precharge control line and the second precharge control line; and level shifters having input terminals coupled to output terminals of the XOR gates and output terminals coupled to scan lines.

In accordance with another aspect of the present disclosure, an exemplary embodiment display device is provided, including: first pixels coupled to data lines and a first scan line; second pixels coupled to the data lines and a second scan line; a data driver configured to sequentially supply, to the data lines, first data voltages corresponding to first grayscale values of the first pixels and second data voltages corresponding to second grayscale values of the second pixels; a scan driver configured to supply a first scan signal to the first scan line, and supply a second scan signal to the second scan line; and a precharge controller configured to determine a width of a pulse of the second scan signal, based on a comparison result of the first grayscale values and the second grayscale values.

The precharge controller may decrease the width of the pulse of the second scan signal as a difference between the first grayscale values and the second grayscale values is increased.

The precharge controller may include: a line comparator configured to compare the first grayscale values and the second grayscale values; and a precharge signal generator configured to apply a first precharge control pulse to a first precharge control line, based on a comparison result of the line comparator, and apply a second precharge control pulse to a second precharge control line, based on a next comparison result. The first precharge control pulse and the second precharge control pulse may not temporally overlap with each other.

The precharge controller may further include: a first line memory configured to store the first grayscale values; and a second line memory configured to store the second grayscale values.

The first line memory may replace grayscale values stored therein that have been compared by the line comparator with grayscale values provided by the second line memory.

The scan driver may include: scan stages configured to sequentially provide scan output signals having scan output pulses to the scan output lines; XOR gates having first input terminals coupled to the scan output lines and second input terminals coupled to one of the first precharge control line and the second precharge control line; and level shifters having input terminals coupled to output terminals of the XOR gates and output terminals coupled to scan lines.

In accordance with still another aspect of the present disclosure, an exemplary embodiment display device is provided, including: pixels coupled to data lines and a scan line; a data driver configured to supply data voltages corresponding to grayscale values of the pixels to the data lines; a scan driver configured to supply a scan signal to the scan line; and a precharge controller configured to determine a width of a pulse of the scan signal, based on a comparison result of current frame grayscale values and previous frame grayscale values of the pixels.

The precharge controller may decrease the width of the pulse of the scan signal as a difference between the current frame grayscale values and the previous frame grayscale values is increased.

The precharge controller may include: a frame comparator configured to compare the current frame grayscale values and the previous frame grayscale values; and a precharge signal generator configured to apply a first precharge control pulse to a first precharge control line, based on a comparison result of the frame comparator, and apply a second precharge control pulse to a second precharge control line, based on a next comparison result. The first precharge control pulse and the second precharge control pulse may not temporally overlap with each other.

The precharge controller may further include: a line memory configured to store the current frame grayscale values; and a frame memory configured to store the previous frame grayscale values, and store grayscale values of a previous frame of pixels coupled to a scan line different from the scan line.

The frame memory may replace grayscale values stored therein that have been compared by the frame comparator with grayscale values provided by the line memory, and store the replaced grayscale values.

The scan driver may include: scan stages configured to sequentially provide scan output signals having scan output pulses to the scan output lines; XOR gates having first input terminals coupled to the scan output lines and second input terminals coupled to one of the first precharge control line and the second precharge control line; and level shifters having input terminals coupled to output terminals of the XOR gates and output terminals coupled to scan lines.

BRIEF DESCRIPTION OF THE DRAWINGS

Exemplary embodiments of the present inventive concept will now be described more fully hereinafter with reference to the accompanying drawings, allowing that the inventive concept may be embodied in different forms and shall not be construed as limited to the embodiments set forth herein. Rather, these embodiments are provided so that this disclosure will be thorough and complete, and will fully convey the scope of the exemplary embodiments to those skilled in the pertinent art.

In the drawing figures, dimensions may be exaggerated for clarity of illustration. It will be understood that when an element is referred to as being "between" two elements, it can be the only element between the two elements, or one or more intervening elements may also be present. Like reference numerals may refer to like elements throughout.

DETAILED DESCRIPTION

Figure 1:
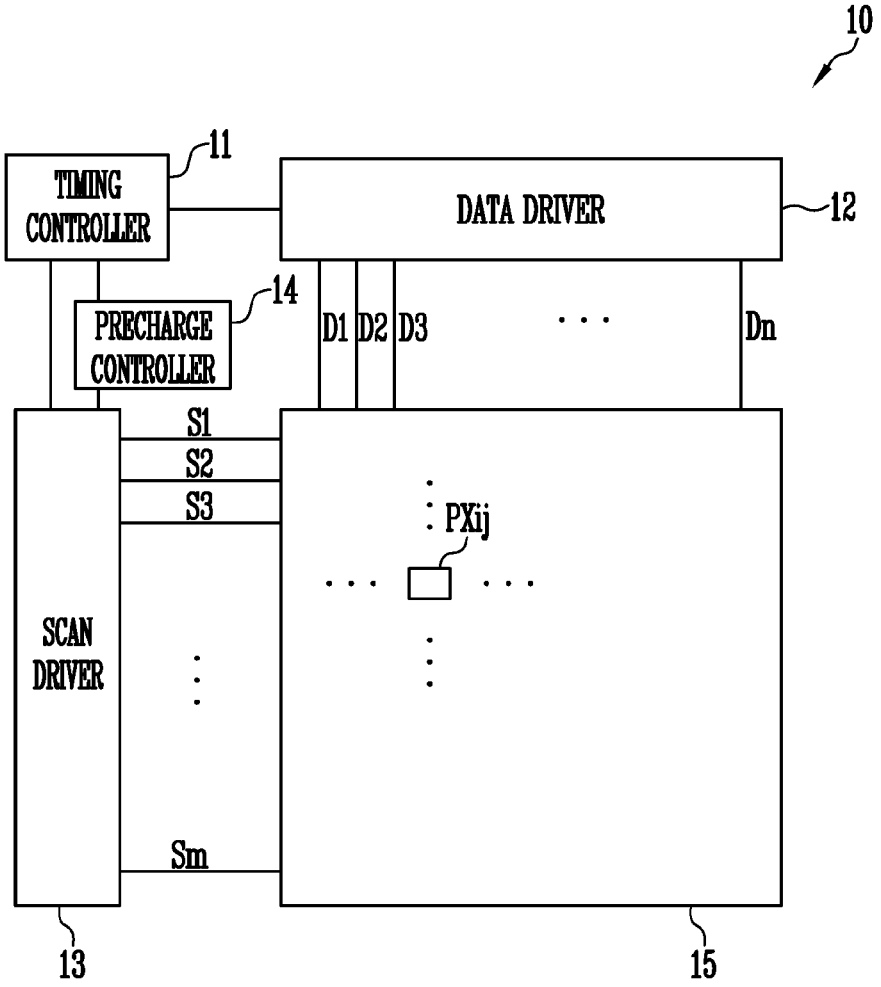
FIG. 1 is a block diagram illustrating a display device in accordance with an embodiment of the present disclosure.

Hereinafter, exemplary embodiments of the present inventive concept are described in detail with reference to the accompanying drawings so that those skilled in the pertinent field of art may easily practice the present disclosure. The present disclosure may be implemented in various different forms and is not limited to the exemplary embodiments described in the present specification.

A part or parts of limited relevance to the description at hand may be omitted to more concisely describe exemplary embodiments of the present disclosure, and the same or similar constituent elements may be designated by the same or similar reference numerals throughout the specification. Therefore, like reference numerals may be used in different drawings to identify like elements.

In addition, the size and thickness of each component illustrated in the drawings are arbitrarily shown for better understanding and ease of description, but the present disclosure is not limited thereto. Thicknesses of several portions and regions may be exaggerated to enhance clarity of expression.

A method of pre-charging a data voltage to each pixel for a horizontal period has been contemplated. At least one embodiment of the present disclosure addresses cases where such pre-charging might otherwise block a data voltage from being charged to each pixel with respect to a pattern of image frames.

FIG. 1 is a block diagram illustrating a display device in accordance with an embodiment of the present disclosure.

Referring to FIG. 1, the display device 10 in accordance with the embodiment of the present disclosure may include a timing controller 11, a data driver 12 connected to the timing controller, a scan driver 13 connected to the timing controller, a precharge controller 14 connected between the timing controller and the scan driver, and a pixel unit 15 connected between the data driver and the scan driver.

The timing controller 11 may receive grayscale values and control signals with respect to respective frames from an external processor. The timing controller 11 may render the grayscale values to correspond to specifications of the display device 10. For example, the external processor may provide a red grayscale value, a green grayscale value, and a blue grayscale value with respect to respective unit dots. However, for example, when the pixel unit 15 has a Pen-Tile™ structure, adjacent unit dots share a pixel, and therefore, pixels may not correspond one-to-one to the respective grayscale values. Accordingly, it may be prudent to render the grayscale values for some pixel structures. When the pixels correspond one-to-one to the respective grayscale values, for example, it may be unnecessary to render the grayscale values. Grayscale values that are rendered and/or those are not rendered may be provided to the data driver 12. Also, the timing controller 11 may provide the data driver 12, the scan driver 13, and the like with control signals suitable for their specifications so as to achieve frame display.

The data driver 12 may generate data voltages to be provided to data lines D1, D2, D3, . . . , and Dn by using grayscale values and control signals. For example, the data driver 12 may sample the grayscale values by using a clock signal, and apply, in units of pixel rows, data voltages corresponding to the grayscale values to the data lines D1 to Dn, where n may be an integer greater than 0.

The precharge controller 14 may apply a first precharge control pulse to a first precharge control line and apply a second precharge control pulse to a second precharge control line, based on comparing grayscale values. Detailed embodiments of the precharge controller 14 will be described in detail later with reference to FIGS. 11 to 13. The precharge controller 14 may be integrally configured with the timing controller 11, or be configured as a separate chip.

The scan driver 13 may generate scan signals to be provided to scan lines S1, S2, S3, . . . , and Sm, where m may be an integer greater than 0, by receiving a clock signal, a scan start signal, and the like from the timing controller 11 and receiving the first and second precharge control pulses from the precharge controller 14. The scan driver 13 may sequentially supply scan signals having pulses of a turn-on level to the scan lines S1, S2, S3, . . . , and Sm. The scan driver 13 may include scan stages configured in a scan stage form.

The scan driver 13 may generate scan signals in a manner that sequentially transfers the scan start signal in the form of a pulse of the turn-on level to a next scan stage under the control of the clock signal. A width of the pulses of the turn-on level, which is included in the scan signals, may be set based on the first precharge control pulse or the second precharge control pulse.

The pixel unit 15 includes pixels. Each pixel PXij may be coupled to a corresponding data line and a corresponding scan line. Here, i and j may be integers greater than 0. The pixel PXij may mean a pixel coupled to an ith scan line and a jth data line.

Figure 2:
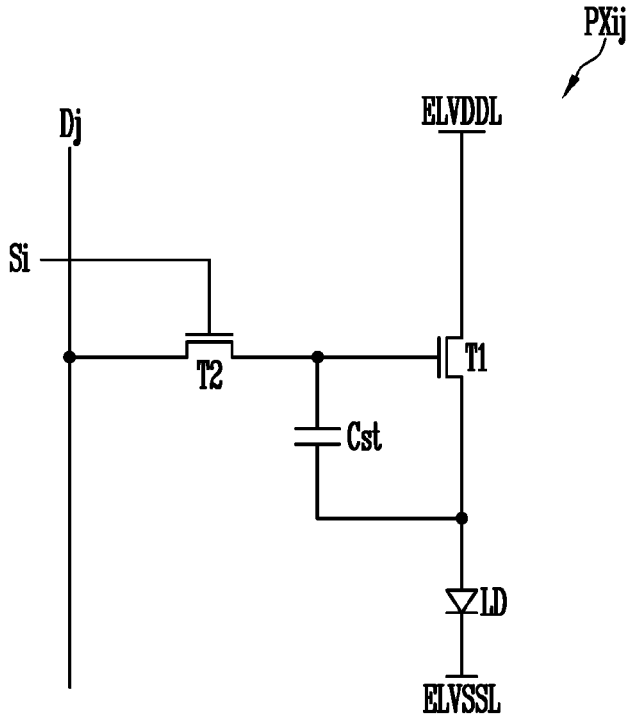
FIG. 2 is a circuit diagram illustrating a pixel in accordance with an embodiment of the present disclosure.

FIG. 2 is a circuit diagram illustrating a pixel in accordance with an embodiment of the present disclosure.

Referring to FIG. 2, the pixel PXij may include transistors T1 and T2, a storage capacitor Cst, and a light emitting diode LD.

Hereinafter, a circuit configured with an N-type transistor will be described as an example. However, those skilled in the art may design a circuit configured with a P-type transistor by changing the polarity of a voltage applied to a gate terminal. Similarly, those skilled in the art may design a circuit configured with a combination of the P-type transistor and the N-type transistor. The P-type transistor refers to a transistor in which an amount of current flowing is increased when the difference in voltage between a gate electrode and a source electrode increases in a negative direction. The N-type transistor refers to a transistor in which an amount of current flowing is increased when the difference in voltage between a gate electrode and a source electrode increases in a positive direction. The transistor may be configured in various forms including a Thin Film Transistor (TFT), a Field Effect Transistor (FET), a Bipolar Junction Transistor (BJT), and the like.

A gate electrode of a first transistor T1 may be coupled to a first electrode of the storage capacitor Cst, a first electrode of the first transistor T1 may be coupled to a first power line ELVDDL, and a second electrode of the first transistor T1 may be coupled to a second electrode of the storage capacitor Cst. The first transistor T1 may be referred to as a driving transistor.

A gate electrode of a second transistor T2 may be coupled to an ith scan line Si, a first electrode of the second transistor T2 may be coupled to a jth data line Dj, and a second electrode of the second transistor T2 may be coupled to the gate electrode of the first transistor T1. The second transistor T2 may be referred to as a scan transistor.

An anode of the light emitting diode LD may be coupled to the second electrode of the first transistor T1, and a cathode of the light emitting diode LD may be coupled to a second power line ELVSSL. The light emitting diode LD may be configured as an organic light emitting diode, an inorganic light emitting diode, a quantum dot light emitting diode, or the like.

A first power voltage may be applied to the first power line ELVDDL, and a second power voltage may be applied to the second power line ELVSS. For example, the first power voltage may be greater than the second power voltage.

When a scan signal of a turn-on level (logic high level) is applied through the scan line Si, the second transistor T2 is in a turn-on state. A data voltage applied to the data line Dj is stored in the first electrode of the storage capacitor Cst.

A positive driving current corresponding to the difference in voltage between the first electrode and the second electrode of the storage capacitor Cst flows between the first electrode and the second electrode of the first transistor T1. Accordingly, the light emitting diode LD emits light with a luminance corresponding to the data voltage.

Next, when a scan signal of a turn-off level (logic low level) is applied through the scan line Si, the second transistor T2 is turned off, and the data line Dj and the first electrode of the storage capacitor Cst are electrically separated from each other. Thus, although the data voltage of the data line Dj is changed, the voltage stored in the first electrode of the storage capacitor Cst is not changed.

Embodiments may be applied to pixels having other circuits, in addition to the pixel PXij shown in FIG. 2.

Figure 3:
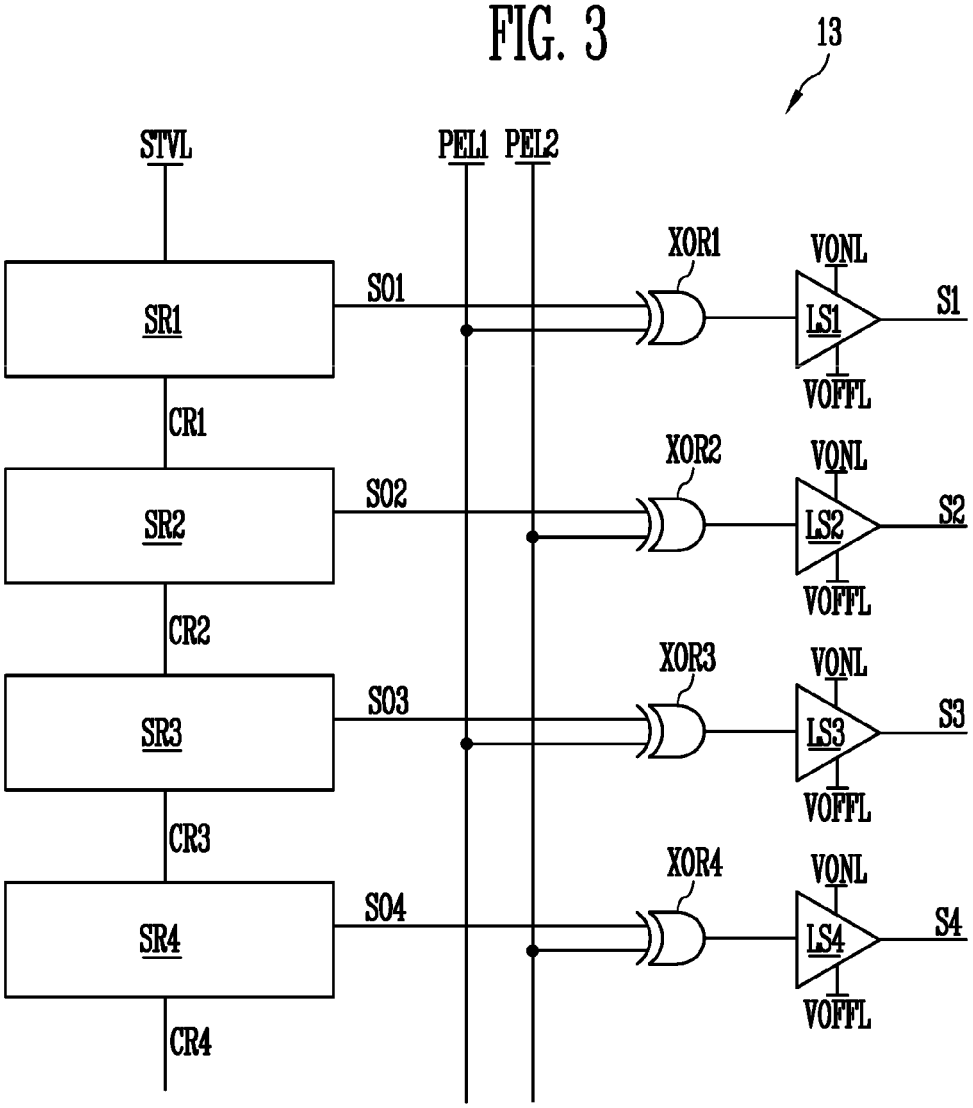
FIG. 3 is a circuit diagram illustrating a scan driver in accordance with an embodiment of the present disclosure.

FIG. 3 is a circuit diagram illustrating a scan driver in accordance with an embodiment of the present disclosure.

Referring to FIG. 3, the scan driver 13 in accordance with the embodiment of the present disclosure includes scan stages SR1, SR2, SR3, and SR4, XOR gates XOR1, XOR2, XOR3, and XOR3, and level shifters LS1, LS2, LS3, and LS4.

The scan stages SR1, SR2, SR3, and SR4 may sequentially provide scan output signals having scan output pulses to scan output lines SO1, SO2, SO3, and SO4.

For example, a first scan stage SR1 may be coupled to a scan start line STVL, a first carry line CR1, and a first scan output line 501. The first scan stage SR1 may receive a scan start signal in the form of a pulse of a turn-on level through the scan start line STVL, output a carry signal to the first carry line CR1, corresponding to the scan start signal, and output a scan output signal in the form of a pulse of the turn-on level to the first scan output line SO1.

For example, a second scan stage SR2 may be coupled to carry lines CR1 and CR2 and a second scan output line SO2.

The second scan stage SR2 may output a carry signal to a second carry line CR2, corresponding to the carry signal received through the first carry line CR1, and output a scan output signal in the form of a pulse of the turn-on level to the second scan output line SO2.

A third scan stage SR3, a fourth scan stage SR4, and the other omitted scan stages may have configurations similar to that of the second scan stage SR2, and be driven in manners similar to that of the second scan stage SR2. Therefore, overlapping descriptions will be omitted.

First input terminals of the XOR gates XOR1, XOR2, XOR3, and XOR4 may be coupled to the scan output lines SO1, SO2, S03, and SO4, and second input terminals of the XOR gates XOR1, XOR2, XOR3, and XOR4 may be coupled to one of a first precharge control line PEL1 and a second precharge control line PEL2.

For example, the second input terminals of the XOR gates XOR1, XOR2, XOR3, and XOR4 may be coupled in an alternating or interleaved configuration to one of the first precharge control line PEL1 and the second precharge control line PEL2.

For example, a first input terminal of a first XOR gate XOR1 may be coupled to the first scan output line SO1, a second input terminal of the first XOR gate XOR1 may be coupled to the first precharge control line PEL1, and an output terminal of the first XOR gate XOR1 may be coupled to an input terminal of a first level shift LS1.

A first input terminal of a second XOR gate XOR2 may be coupled to the second scan output line SO2, a second input terminal of the second XOR gate XOR2 may be coupled to the second precharge control line PEL2, and an output terminal of the second XOR gate XOR2 may be coupled to a second level shifter LS2.

A third XOR gate XOR3, a fourth XOR gate XOR4, and the other omitted XOR gates may have similar configurations and be driven in similar manners. Therefore, overlapping descriptions will be omitted.

Each of the XOR gates XOR1, XOR2, XOR3, and XOR4 may output a control signal of a first level, when logic values of the first input terminal and the second input terminal are different from each other. Also, each of the XOR gates XOR1, XOR2, XOR3, and XOR4 may output a control signal of a second level different from the first level, when logic values of the first input terminal and the second input terminal are equal to each other.

Input terminals of the level shifters LS1, LS2, LS3, and LS4 may be coupled to the output terminals of the XOR gates XOR1, XOR2, XOR3, and XOR4, and output terminals of the level shifters LS1, LS2, LS3, and LS4 may be coupled to may be coupled to scan line S1, S2, S3, and S4. The level shifters LS1, LS2, LS3, and LS4 may be coupled to an on-voltage line VONL and an off-voltage line VOFFL.

For example, when the control signal of the first level is input from the first XOR gate XOR1, the first level shift LS1 may apply an on-voltage (e.g., a logic high level) of the on-voltage line VONL to a first scan line S1. Also, when the control signal of the second level is input from the first XOR gate XOR1, the first level shift LS1 may apply an off-voltage (e.g., a logic low level) of the off-voltage line VOFFL to the first scan line S1.

The XOR gates XOR2, XOR3, and XOR4 and the other XOR gates may have configurations similar to that of the first XOR gate XOR1, and be driven in manners similar to that of the first XOR gate XOR1. Therefore, overlapping descriptions will be omitted.

Figure 4:
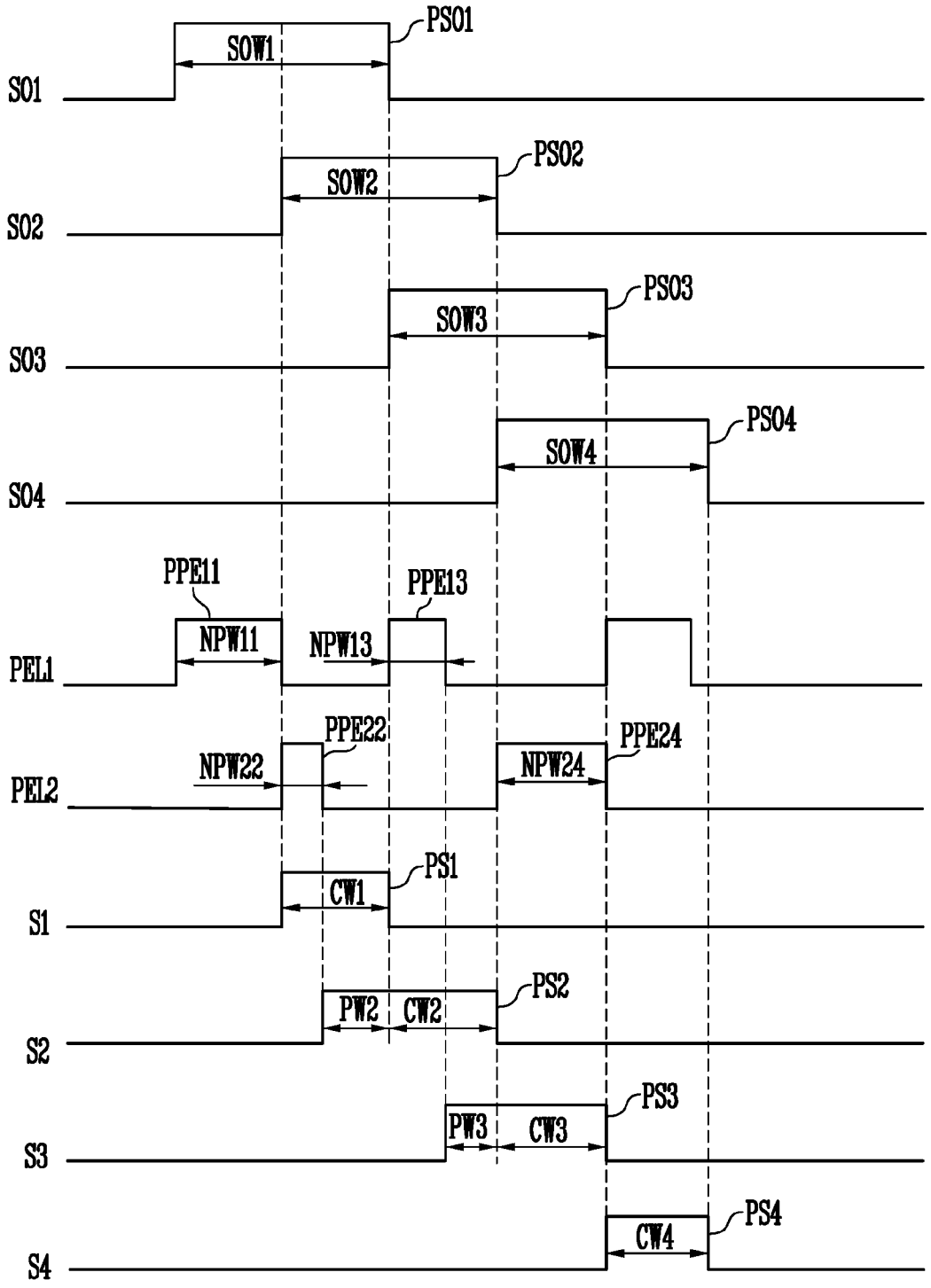
FIG. 4 is a timing diagram illustrating a driving method of the scan driver in accordance with an embodiment of the present disclosure.

FIG. 4 is a timing diagram illustrating a driving method of the scan driver in accordance with an embodiment of the present disclosure.

Widths SOW1, SOW2, SOW3, and SOW4 of pulses PSO1, PSO2, PSO3, and PSO4 of the scan output lines SO1, SO2, SO3, and SO4 may be equal to one another. For example, the widths SOW1, SOW2, SOW3, and SOW4 may correspond to two horizontal periods.

Widths NPW11 and NPW13 of first precharge pulses PPE11 and PPE13 of the first precharge control line PEL1 may correspond to one horizontal period or less. In addition, widths NPW22 and NPW24 of second precharge pulses PPE22 and PPE24 of the second precharge control line PEL2 may correspond to one horizontal period or less.

Referring also to the configuration shown in FIG. 3, a width CW1 of a pulse PS1 of the first scan line S1 may correspond to the difference between the SOW1 of the pulse PSO1 of the first scan output line SO1 and the width NPW11 of the first precharge control pulse PPE11 of the first precharge control line PEL1. For example, when the width NPW11 of the first precharge control pulse PPE11 has a maximum value as one horizontal period, the CW1 of the pulse PS1 may correspond to one horizontal period such that pixels coupled to the first scan line S1 are not precharged.

A width of a pulse PS2 of a second scan line S2 may correspond to the difference between the width SOW2 of the pulse PSO2 of the second scan output line SO2 and the width NPW22 of the second precharge control pulse PPE22 of the second precharge control line PEL2. For example, the width NPW22 of the second precharge control pulse PPE22 may correspond to less than one horizontal period. For example, the width of the pulse PS2 may correspond to the sum of a width PW2 for precharging a pixel by using a data voltage of a previous horizontal period and a width CW2 for charging the pixel by using a data voltage of a current horizontal period.

Pulses PS3 and PS4 and pulses of the other omitted scan signals may be generated similarly to the above-described pulses, and therefore, overlapping descriptions will be omitted.

Figure 5:
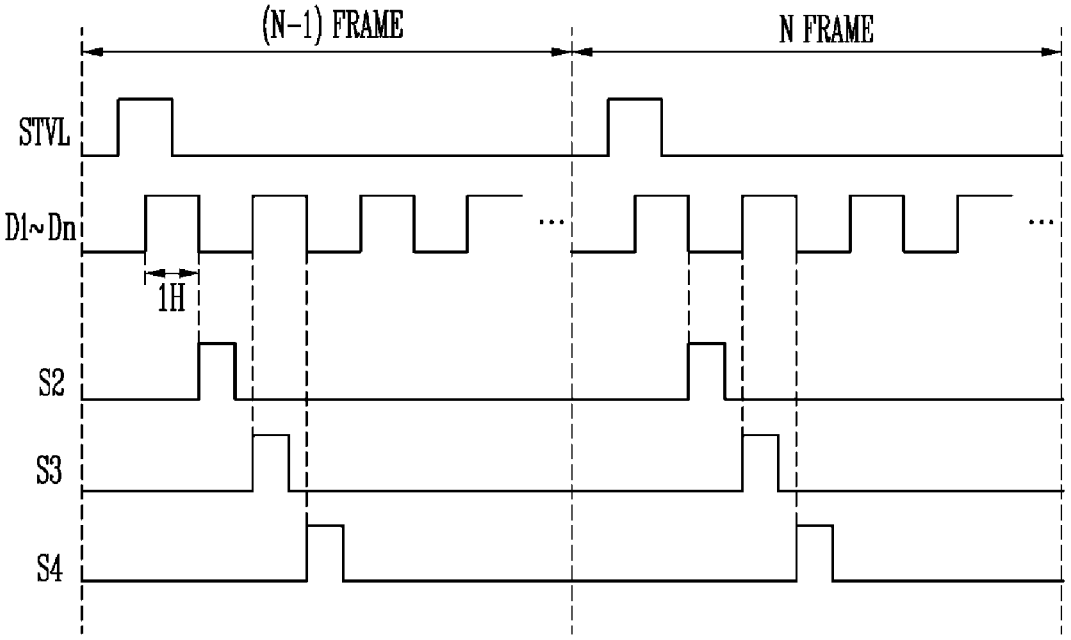
FIGS. 5 and 6 are timing diagrams illustrating an exemplary first pattern of image frames.
Figure 6:
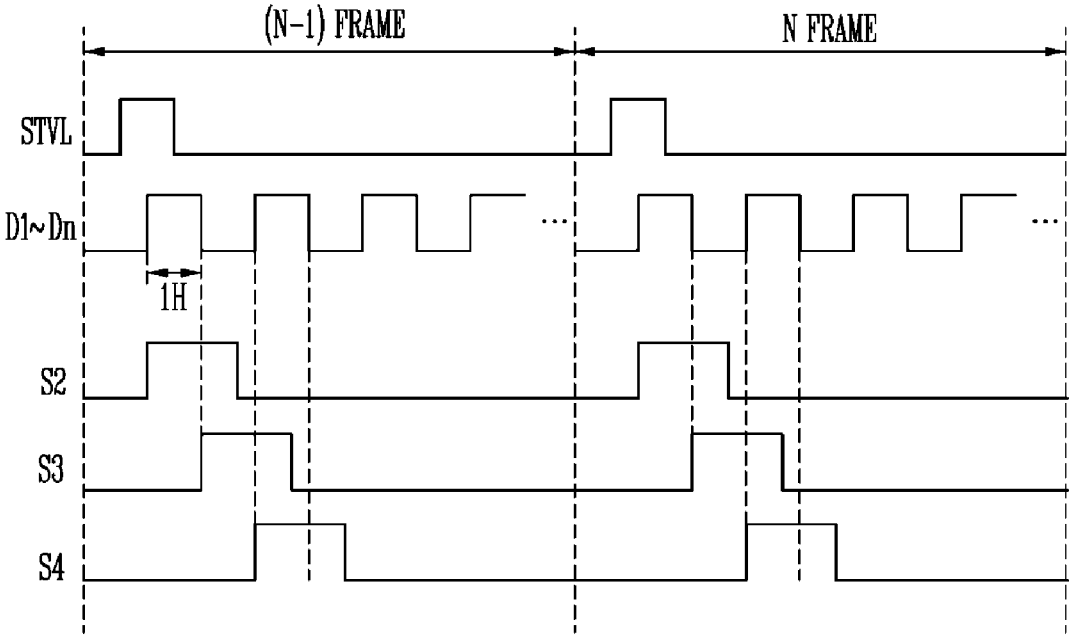

FIGS. 5 and 6 are timing diagrams illustrating an exemplary first pattern of image frames (Exemplary Data 1).

Referring to FIGS. 5 and 6, two exemplary frames (N-1) FRAME and N FRAME are illustrated. A pulse may be applied to the scan start line STVL at a start time of each of the frames (N-1) FRAME and N FRAME.

In the frames (N-1) FRAME and N FRAME shown in FIGS. 5 and 6, a data voltage of a high level and a data voltage of a low level are alternately applied in a unit of one horizontal period to the data lines D1 to Dn. Pixels to which the data voltage of the high level is applied may emit light, as white, and pixels to which the data voltage of the low level is applied may filter or not emit light, as black. That is, in the frames (N-1) FRAME and N FRAME shown in FIGS. 5 and 6, the display device 10 displays a horizontal stripe pattern.

Pulses having no width for precharge are applied to scan lines S2, S3, and S4 shown in FIG. 5, and pulses having a full horizontal period width for precharge are applied to scan lines S2, S3, and S4 shown in FIG. 6.

In FIG. 5, pixels coupled to second and fourth scan lines S2 and S4 may be consistently charged with a data voltage corresponding to the black, and pixels coupled to a third scan line S3 may be consistently charged with a data voltage corresponding to the white.

However, in FIG. 6, pixels coupled to second and fourth scan lines S2 and S4 are precharged with the data voltage corresponding to the white and then charged with the data voltage corresponding to the black, and pixels coupled to a third scan line S3 are precharged with the data voltage corresponding to the black and then charged with the data voltage corresponding to the white. Therefore, since there is no consistency of the data voltage, the precharge may interfere with charge of pixels.

Accordingly, when the display device 10 displays the horizontal stripe pattern, a case where the precharge is not performed (e.g., FIG. 5) is more preferable.

Figure 7:
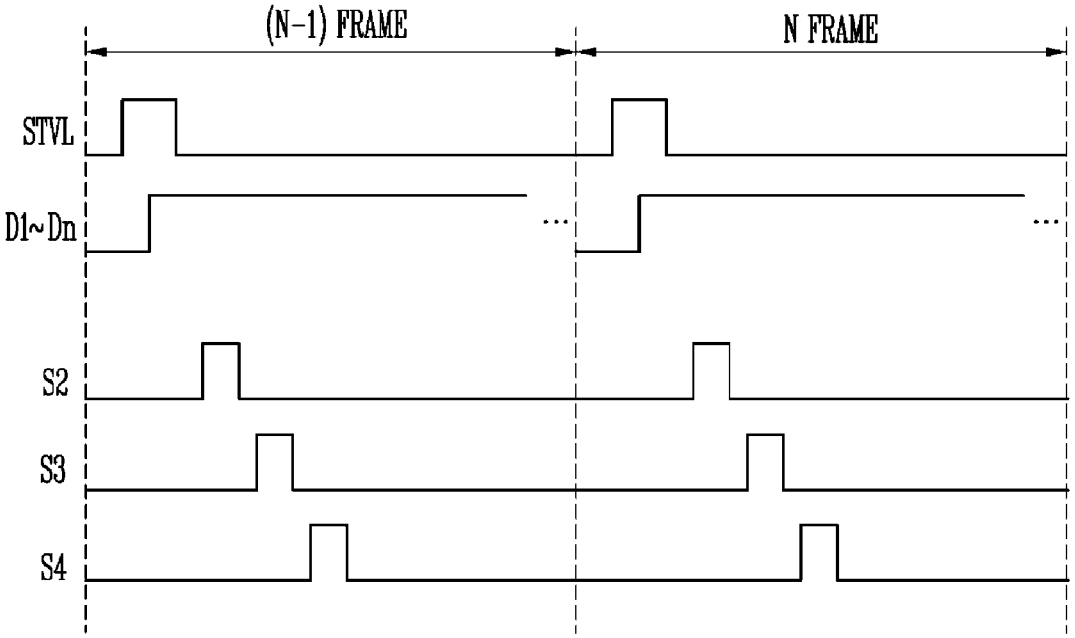
FIGS. 7 and 8 are timing diagrams illustrating an exemplary second pattern of image frames.
Figure 8:
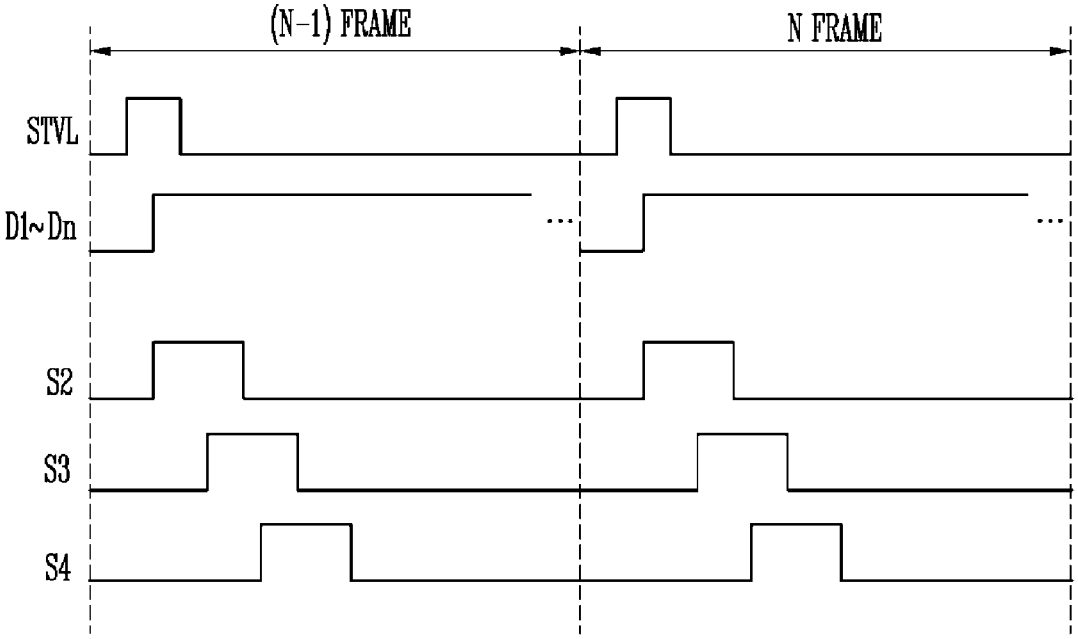

FIGS. 7 and 8 are timing diagrams illustrating an exemplary second pattern of image frames (Exemplary Data 2).

In frames (N-1) FRAME and N FRAME shown in FIGS. 7 and 8, a data voltage of a high level is continuously applied to the data lines D1 to Dn. Pixels to which the data voltage of the high level is applied may emit light, as white. That is, in the frames (N-1) FRAME and N FRAME shown in FIGS. 7 and 8, the display device 10 displays a white pattern.

Pulses having no width for precharge are applied to scan lines S2, S3, and S4 shown in FIG. 7, and pulses having a width for precharge are applied to scan lines S2, S3, and S4 shown in FIG. 8.

In both FIGS. 7 and 8, pixels coupled to the scan lines S2, S3, and S4 may be consistently charged with a data voltage corresponding to the white. The precharge is performed as shown in FIG. 8, so that a data voltage charge period of each of the pixels is preferably further secured.

Figure 9:
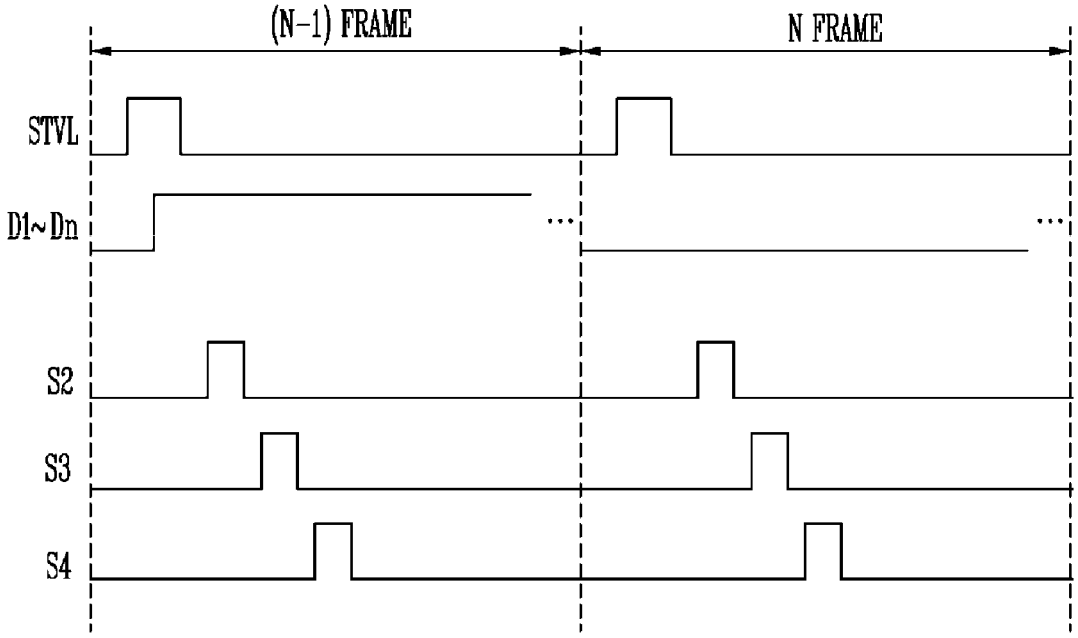
FIGS. 9 and 10 are timing diagrams illustrating an exemplary third pattern of image frames.
Figure 10:
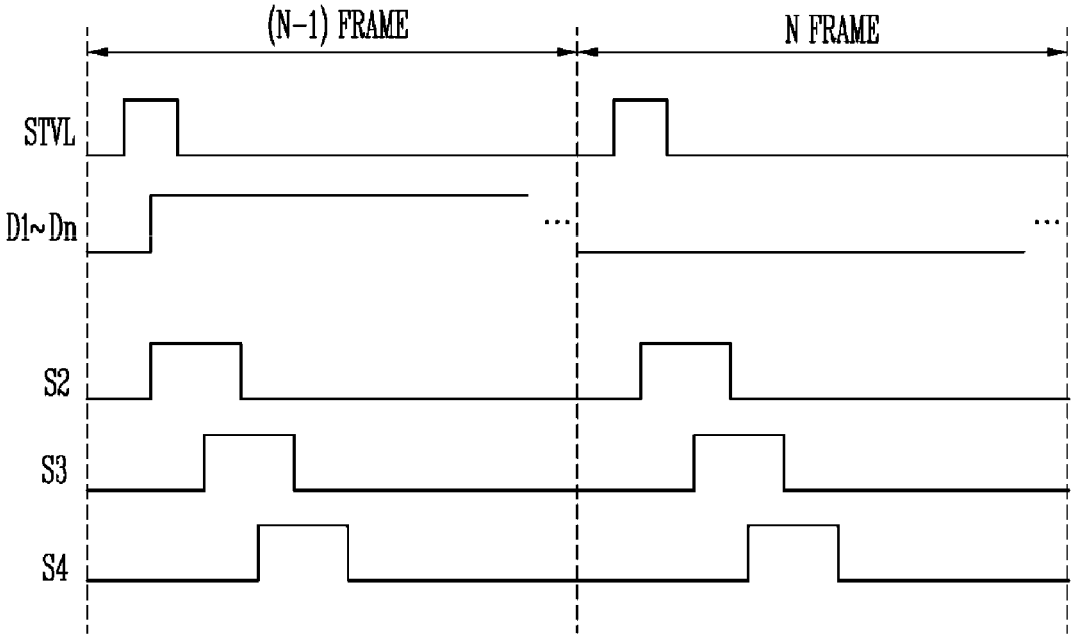

FIGS. 9 and 10 are timing diagrams illustrating an exemplary third pattern of image frames (Exemplary Data 3).

In an (N-1)th frame, (N-1) FRAME shown in FIGS. 9 and 10, a data voltage of a high level is continuously applied to the data lines D1 to Dn. Pixels to which the data voltage of the high level is applied may emit light, as white. In an Nth frame, N FRAME shown in FIGS. 9 and 10, a data voltage of a low level is continuously applied to the data lines D1 to Dn. Pixels to which the data voltage of the low level is applied may filter or not emit light, as black. That is, in the frames (N-1) FRAME and N FRAME shown in FIGS. 9 and 10, the display device 10 alternately display a solid white pattern and then a solid black pattern.

Pulses having no width for precharge are applied to scan lines S2, S3, and S4 shown in FIG. 9, and pulses having a pulse for precharge are applied to scan lines S2, S3, and S4 shown in FIG. 10.

In both FIGS. 9 and 10, in each of the frames (N-1) FRAME and N FRAME, pixels coupled to the scan lines S2, S3, and S4 may be consistently charged with a data voltage corresponding to the white or the black. The precharge is performed as shown in FIG. 10, so that a data voltage charge period of each of the pixels is preferably further secured.

Figure 11:
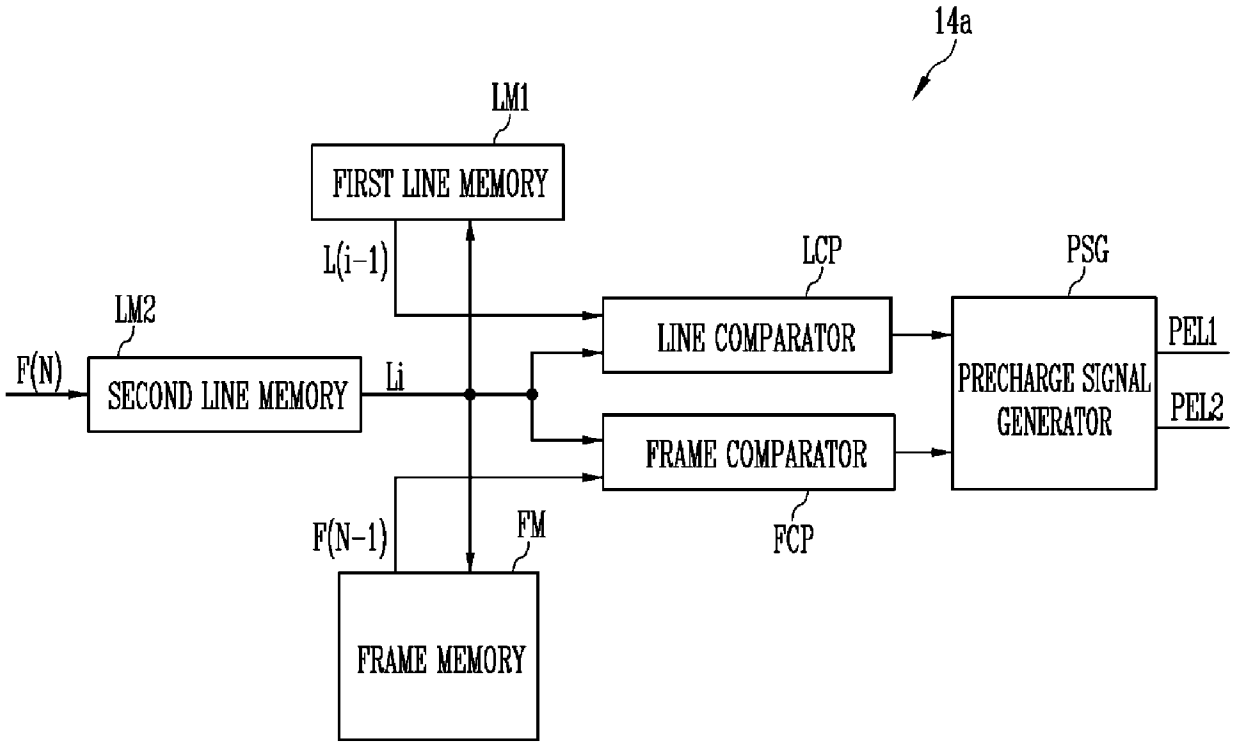
FIG. 11 is a block diagram illustrating a precharge controller in accordance with an embodiment of the present disclosure.

FIG. 11 is a block diagram illustrating a precharge controller in accordance with an embodiment of the present disclosure.

Referring to FIG. 11, the precharge controller 14*a* in accordance with the embodiment of the present disclosure may include line memories LM1 and LM2, a frame memory FM, a line comparator LCP, a frame comparator FCP, and a precharge signal generator PSG.

The pixel unit 15 may include first pixels coupled to the data lines D1 to Dn and the first scan line S1 and second pixels coupled to the data lines D1 to Dn and the second scan line S2.

The data driver 12 may sequentially supply, to the data lines D1 to Dn, first data voltages corresponding to first grayscale values L(i-1) of the first pixels and second data voltages corresponding to second grayscale values Li of the second pixels. The first grayscale values L(i-1) may be grayscale values before one horizontal period as compared with the second grayscale values Li.

The scan driver 13 may supply a first scan signal to the first scan line S1, and supply a second scan signal to the second scan line S2. A pulse of the second scan signal may be subsequent to that of the first scan signal.

The precharge controller 14*a* may determine a width of a pulse of the second scan signal, based on a comparison result of the current N FRAME's (hereinafter F(N) frame's) second grayscale values Li of the second pixels with the previous (N-1) FRAME's (hereinafter F(N-1) frame's) grayscale values of the second pixels, and based on a comparison result of the first grayscale values L(i-1) of the first pixels with the second grayscale values Li of the second pixels.

For example, the precharge controller 14*a* may determine a width of the pulse of the second scan signal, based on a smaller of the values between a first difference value as a difference between the current frame's F(N) second grayscale values Li and the previous frame's F(N-1) second grayscale values and a second difference value as a difference between the current frame's first grayscale values L(i-1) and the current frame's second grayscale values Li. In particular, the precharge controller 14*a* may decrease the width of the pulse of the second scan signal as the smaller value is increased. Do to the exclusive-OR (XOR) effect, that the precharge controller 14*a* ultimately decreases the width of the pulse of the second scan signal may be accomplished by the precharge signal generator PSG increasing the width of a first precharge control pulse or second precharge control pulse (see FIGS. 3 and 4).

For example, in the white pattern (see FIGS. 7 and 8), the first difference value corresponds to the minimum value, and the second difference value corresponds to the minimum value. Therefore, the width of the pulse of the second scan signal may be determined as the maximum value. That is, the display device 10 can maximize an amount of precharge of the pixels as shown in FIG. 8, which is preferable.

For example, when the display device 10 alternately displays the white pattern and the black pattern (see FIGS. 9 and 10), the first difference value corresponds to the maximum value, and the second difference value corresponds to the minimum value. Therefore, the width of the pulse of the second scan signal may be determined as the maximum value according to the second difference value. That is, the display device 10 can maximize an amount of precharge of the pixels as shown in FIG. 10, which is preferable.

However, when the display device 10 displays the horizontal stripe pattern (see FIGS. 5 and 6), it is necessary to perform exception processing. That is, the precharge controller 14a (or the precharge signal generator PSG) may maximally decrease the width of the pulse of the second scan signal, when the second difference value is equal to or greater than a reference value. In other words, the precharge controller 14*a* (or the precharge signal generator PSG) may not perform precharge. Thus, the display device 10 can minimize an amount of precharge of the pixels as shown in FIG. 5, which is preferable.

The frame comparator FCP may provide the first difference value by comparing the second grayscale values Li of the current frame F(N) and the second grayscale values of the previous frame F(N-1).

The line comparator LCP may provide the second difference value by comparing the first grayscale values L(i-1) and the second grayscale values Li.

The precharge signal generator PSG may apply the first precharge control pulse to the first precharge control line PEL1, based on a comparison result of the frame comparator FCP and the line comparator LCP, and apply the second precharge control pulse to the second precharge control line PEL2, based on a next comparison result. The first precharge control pulse and the second precharge control pulse may not temporally overlap with each other. For example, the precharge signal generator PSG may alternately generate the first precharge control pulse and the second precharge control pulse in the unit of one horizontal period.

A first line memory LM1 may store the first grayscale values L(i-1). The first line memory LM1 may be designed to have a capacity capable of storing grayscale values corresponding to one horizontal period.

A second line memory LM2 may receive the current frame F(N) and store the second grayscale values Li. The second line memory LM2 may be designed to have a capacity capable of storing grayscale values corresponding to one horizontal period.

The frame memory FM may store the grayscale values of the previous frame F(N-1). The frame memory FM may be designed to have a capacity capable of storing grayscale values corresponding to one frame.

The frame memory FM may replace grayscale values stored therein that have been compared by the frame comparator FCP with grayscale values provided by the second line memory LM2, and store the replaced grayscale values. That is, some of the previous frame F(N-1) grayscale values and grayscale values of a current frame may coexist in the frame memory FM. Accordingly, it is unnecessary to provide two frame memories so as to compare the previous frame grayscale values and the current frame grayscale values, and thus configuration cost can be reduced.

The first line memory LM1 replaces grayscale values stored therein that have been compared by the line comparator LCP with grayscale values provided by the second line memory LM2.

Figure 12:
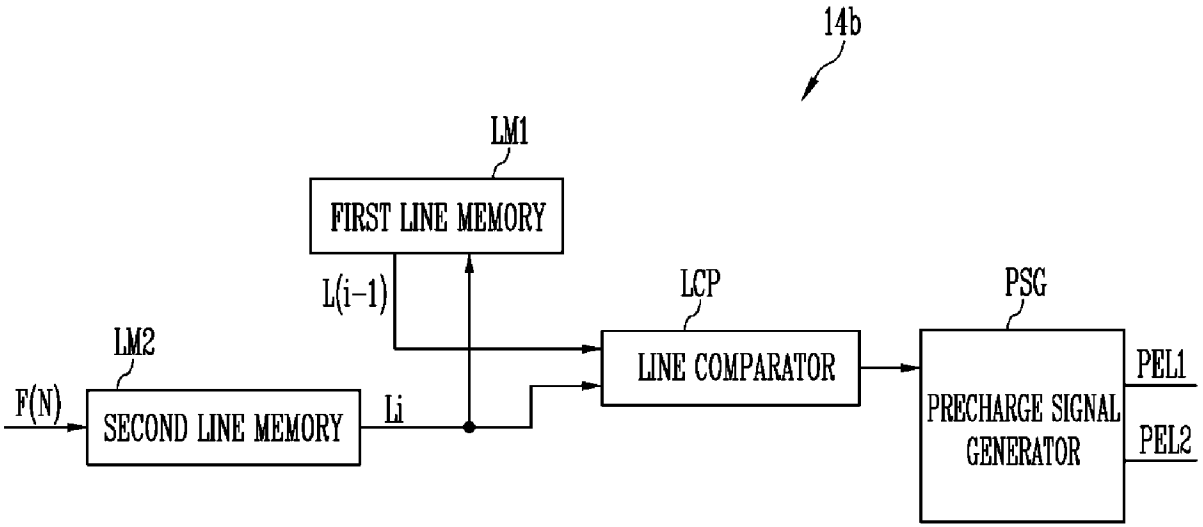
FIG. 12 is a block diagram illustrating a precharge controller in accordance with another embodiment of the present disclosure.

FIG. 12 is a block diagram illustrating a precharge controller in accordance with an embodiment of the present disclosure.

As compared with the precharge controller 14*a* shown in FIG. 11, in the precharge controller 14*b* shown in FIG. 12, the configurations of the frame memory FM and the frame comparator FCP are eliminated. Descriptions of components overlapping with those shown in FIG. 11 will be omitted.

The precharge controller 14*b* may determine a width of a pulse of the second scan signal, based on a comparison result of the first grayscale values L(i-1) and the second grayscale values Li. For example, the precharge controller 14*b* may decrease the width of the pulse of the second scan signal as the difference between the first grayscale values L(i-1) and the second grayscale values Li is increased.

According to the precharge controller 14*b* shown in FIG. 12, when the display device 10 displays the horizontal stripe pattern, an amount of precharge of the pixels can be minimized as shown in FIG. 5, which is preferable.

Figure 13:
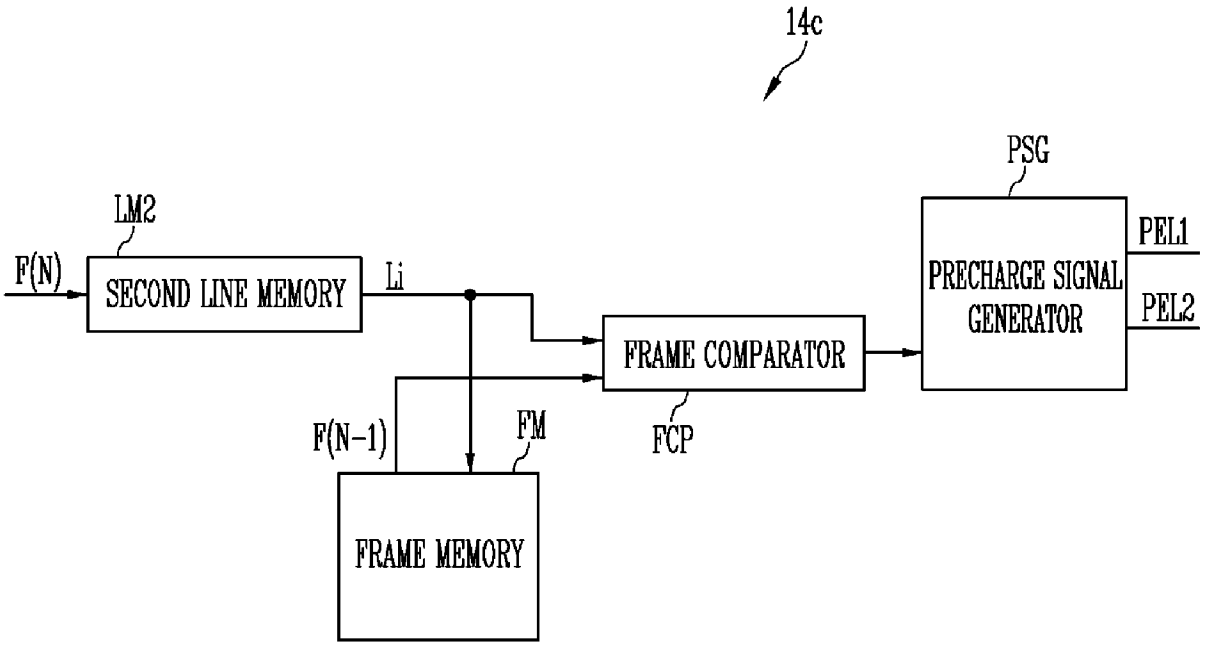
FIG. 13 is a block diagram illustrating a precharge controller in accordance with still another embodiment of the present disclosure.

FIG. 13 is a block diagram illustrating a precharge controller in accordance with an embodiment of the present disclosure.

As compared with the precharge controller 14*a* shown in FIG. 11, in the precharge controller 14*c* shown in FIG. 13, the configurations of the first line memory LM1 and the line comparator LCP are eliminated. Descriptions of components overlapping with those shown in FIG. 11 will be omitted.

The precharge controller 14*c* may determine a width of a pulse of a scan signal to be applied to pixels, based on a comparison result of current frame F(N) grayscale values Li and previous frame F(N-1) grayscale values of the pixels. For example, the precharge controller 14*c* may decrease the width of the pulse of the scan signal as the difference between the current frame F(N) grayscale values Li and the previous frame F(N-1) grayscale values increases.

According to the precharge controller 14*c* shown in FIG. 13, when the display device 10 displays the white pattern, the display device 10 can maximize an amount of precharge of the pixels as shown in FIG. 8, which is preferable.

In the display device in accordance with the present disclosure, an amount of precharge can be properly determined according to a pattern of image frames.

In an alternate embodiment, a precharge controller schematically comparable to the precharge controller 14*a* of FIG. 11 may determine a pulse-width of the second scan signal as a function of first differences Q1 and second differences Q2, normalized to one (1), where the first differences Q1 are the differences between the current frame F(N) first grayscale values L(N,i-1) and the current frame F(N) second grayscale values L(N,i), and the second differences Q2 are the differences between the current frame F(N) second grayscale values L(N,i) and the previous frame F(N-1) second grayscale values L(N-1,i). In particular, this precharge controller embodiment may increase the pulse-width of the second scan signal as the first differences decrease or the second differences increase, such as, for example, as a function of $(1+Q2)*(1-Q1)/2$.

Thus, when the display device 10 of FIG, 1 displays the horizontal stripe pattern of FIGS. 5 and 6 according to the alternate embodiment, where Q1 is maximized towards one (1) and Q2 is minimized towards zero (0), the result approaches zero so the precharge controller may decrease the pulse-width of the second scan signal to minimize the precharge of the pixels as shown in FIG. 5. When the display device 10 displays the white pattern of FIGS. 7 and 8 according to the alternate embodiment, where both Q1 and Q2 are minimized, the result approaches one-half (½) where the precharge controller may adjust the width of the pulse of the second scan signal to medium for some precharge of the pixels as shown in FIG. 8. When the display device alternately displays the white pattern and then the black pattern as shown in FIGS. 9 and 10 according to the alternate embodiment, when Q1 is minimized and Q2 is maximized, the result approaches one (1) so the precharge controller may increase the pulse-width of the second scan signal to maximize the precharge of the pixels as shown in FIG. 10.

Exemplary embodiments have been disclosed herein, and although specific terms are employed, they are used and are to be interpreted in a generic and descriptive sense only and not for purposes of limitation. In some instances, as would be apparent to one of ordinary skill in the pertinent art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of ordinary skill in the pertinent art that various changes in form and details may be made without departing from the spirit and scope of the present disclosure as set forth in the following claims.

What is claimed is:

1. A display device comprising:

first pixels coupled to data lines and a first scan line;

second pixels coupled to the data lines and a second scan line;

a data driver configured to sequentially supply, to the data lines, first data voltages corresponding to first grayscale values of the first pixels and second data voltages corresponding to second grayscale values of the second pixels;

a scan driver configured to supply a first scan signal to the first scan line, and supply a second scan signal to the second scan line; and a precharge controller configured to determine a width of a pulse of the second scan signal, based on a comparison result of the second grayscale values and previous frame grayscale values and a comparison result of the first grayscale values and the second grayscale values.

2. The display device of claim 1, wherein the precharge controller determines the width of the pulse of the second scan signal, based on a smaller value between a first difference value as a difference between the second grayscale values and the previous frame grayscale values and a second difference value as a difference between the first grayscale values and the second grayscale values.

3. The display device of claim 2, wherein the precharge controller decreases the width of the pulse of the second scan signal as the smaller value is increased.

4. The display device of claim 3, wherein the precharge controller includes:

a frame comparator configured to provide the first difference value by comparing the second grayscale values and the previous frame grayscale values;

a line comparator configured to provide the second difference value by comparing the first grayscale values and the second grayscale values; and a precharge signal generator configured to apply a first precharge control pulse to a first precharge control line, based on a comparison result of the frame comparator and the line comparator, and apply a second precharge control pulse to a second precharge control line, based on a next comparison result, wherein the first precharge control pulse and the second precharge control pulse do not temporally overlap with each other.

5. The display device of claim 4, wherein the precharge controller further includes:

a first line memory configured to store the first grayscale values;

a second line memory configured to store the second grayscale values; and a frame memory configured to store the previous frame grayscale values.

6. The display device of claim 5, wherein the frame memory replaces grayscale values stored therein that have been compared by the frame comparator with grayscale values provided by the second line memory.

7. The display device of claim 6, wherein the first line memory replaces grayscale values stored therein that have been compared by the line comparator with grayscale values provided by the second line memory.

8. The display device of claim 4, wherein the scan driver includes:

scan stages configured to sequentially provide scan output signals having scan output pulses to scan output lines;

XOR gates having first input terminals coupled to the scan output lines and second input terminals coupled to one of the first precharge control line and the second precharge control line; and level shifters having input terminals coupled to output terminals of the XOR gates and output terminals coupled to scan lines.

9. A display device comprising:

first pixels coupled to data lines and a first scan line;

second pixels coupled to the data lines and a second scan line;

a data driver configured to sequentially supply, to the data lines, first data voltages corresponding to first grayscale values of the first pixels and second data voltages corresponding to second grayscale values of the second pixels;

a scan driver configured to supply a first scan signal to the first scan line, and supply a second scan signal to the second scan line; and a precharge controller configured to determine a width of a pulse of the second scan signal, based on a comparison result of the first grayscale values and the second grayscale values.

10. The display device of claim 9, wherein the precharge controller decreases the width of the pulse of the second scan signal as a difference between the first grayscale values and the second grayscale values is increased.

11. The display device of claim 10, wherein the precharge controller includes:

a line comparator configured to compare the first grayscale values and the second grayscale values; and a precharge signal generator configured to apply a first precharge control pulse to a first precharge control line, based on a comparison result of the line comparator, and apply a second precharge control pulse to a second precharge control line, based on a next comparison result, wherein the first precharge control pulse and the second precharge control pulse do not temporally overlap with each other.

12. The display device of claim 11, wherein the precharge controller further includes:

a first line memory configured to store the first grayscale values; and a second line memory configured to store the second grayscale values.

13. The display device of claim 12, wherein the first line memory replaces grayscale values that have been compared by the line comparator among grayscale values stored therein with grayscale values provided by the second line memory.

14. The display device of claim 11, wherein the scan driver includes:

scan stages configured to sequentially provide scan output signals having scan output pulses to scan output lines;

XOR gates having first input terminals coupled to the scan output lines and second input terminals coupled to one of the first precharge control line and the second precharge control line; and level shifters having input terminals coupled to output terminals of the XOR gates and output terminals coupled to scan lines.

15. A display device comprising:

pixels coupled to data lines and a scan line;

a data driver configured to supply data voltages corresponding to grayscale values of the pixels to the data lines;

a scan driver configured to supply a scan signal to the scan line; and a precharge controller configured to determine a width of a pulse of the scan signal, based on a comparison result of current frame grayscale values and previous frame grayscale values of the pixels.

16. The display device of claim 15, wherein the precharge controller decreases the width of the pulse of the scan signal as a difference between the current frame grayscale values and the previous frame grayscale values is increased.

17. The display device of claim 16, wherein the precharge controller includes:

a frame comparator configured to compare the current frame grayscale values and the previous frame grayscale values; and a precharge signal generator configured to apply a first precharge control pulse to a first precharge control line, based on a comparison result of the frame comparator, and apply a second precharge control pulse to a second precharge control line, based on a next comparison result, wherein the first precharge control pulse and the second precharge control pulse do not temporally overlap with each other.

18. The display device of claim 17, wherein the precharge controller further includes:

a line memory configured to store the current frame grayscale values; and a frame memory configured to store the previous frame grayscale values, and store grayscale values of a previous frame of pixels coupled to a scan line different from the scan line.

19. The display device of claim 18, wherein the frame memory replaces grayscale values that have been compared by the frame comparator among grayscale values stored therein with grayscale values provided by the line memory, and stores the replaced grayscale values.

20. The display device of claim 17, wherein the scan driver includes:

scan stages configured to sequentially provide scan output signals having scan output pulses to scan output lines;

XOR gates having first input terminals coupled to the scan output lines and second input terminals coupled to one of the first precharge control line and the second precharge control line; and level shifters having input terminals coupled to output terminals of the XOR gates and output terminals coupled to scan lines.

* * * * *